US011732880B2

(12) United States Patent
Bordes

(10) Patent No.: US 11,732,880 B2
(45) Date of Patent: Aug. 22, 2023

(54) LED SYSTEM WITHOUT HEAT SINK

(71) Applicant: Agomoon SRL, Manage (BE)

(72) Inventor: Jacques Bordes, Sartilly-Baie-Bocage (FR)

(73) Assignee: Agomoon SRL, Manage (BE)

( * ) Notice: Subject to any disclaimer, the term of this patent is extended or adjusted under 35 U.S.C. 154(b) by 0 days.

(21) Appl. No.: 17/908,251

(22) PCT Filed: Feb. 23, 2021

(86) PCT No.: PCT/IB2021/051511
§ 371 (c)(1),
(2) Date: Aug. 31, 2022

(87) PCT Pub. No.: WO2021/176302
PCT Pub. Date: Sep. 10, 2021

(65) Prior Publication Data

US 2023/0123362 A1 Apr. 20, 2023

(30) Foreign Application Priority Data

Mar. 5, 2020 (FR) ..... 2002246

(51) Int. Cl.
*F21V 29/87* (2015.01)
*F21S 4/28* (2016.01)
(Continued)

(52) U.S. Cl.
CPC ..... *F21V 29/87* (2015.01); *F21S 4/28* (2016.01); *F21Y 2105/16* (2016.08); *F21Y 2115/10* (2016.08)

(58) Field of Classification Search
CPC ..... F21V 29/87; F21S 4/28; F21Y 2105/16; F21Y 2115/10
See application file for complete search history.

(56) References Cited

U.S. PATENT DOCUMENTS 8,757,832 B2 * 6/2014 Kim ..... F21K 9/27 362/249.02
2014/0009923 A1 * 1/2014 Wu ..... F21K 9/27 362/218

(Continued)

FOREIGN PATENT DOCUMENTS

EP 2287524 2/2011
EP 3312506 A1 * 4/2018 ..... F21S 2/00
FR 3045777 6/2017

OTHER PUBLICATIONS

English translation of Eistetter EP-3312506-A1, published Apr. 2018 (Year: 2018).*

(Continued)

*Primary Examiner* — Evan P Dzierzynski

(57) ABSTRACT

The invention relates to a powerful, robust and durable light-emitting diode lighting system with a protection rating of up to IP69, while maintaining a low manufacturing cost. It consists of an insulated metal substrate, on which at least one light-emitting diode is placed, supplied by a cable or a connector. The resulting circuit is then wrapped in a heat-shrinkable sheath, which will remove the air and dissipate the heat from the substrate and diodes in an optimal manner, the heat dissipation power thereof being about ten times that of air. Each end is then overmoulded, in order to make the system sealed and robust. The overmoulding can be used to add a sealing lip around the connector, as well as specific recesses to allow various attachment methods, individually or in groups.
The device according to the invention is intended for domestic, industrial and horticultural lighting, depending on whether a translucent or transparent substrate is used.

7 Claims, 4 Drawing Sheets

(51) Int. Cl.
*F21Y 105/16* (2016.01)
*F21Y 115/10* (2016.01)

(56) References Cited

U.S. PATENT DOCUMENTS

2014/0131741 A1* 5/2014 Zykin ..... H01L 33/647 438/28
2017/0192574 A1* 7/2017 Koike ..... G06F 3/047
2021/0116077 A1* 4/2021 Jiang ..... F21V 19/005

OTHER PUBLICATIONS

Rapport de Recherche Internationale et l'Opinion Écrite [International Search Report and the Written Opinion] dated Jun. 8, 2021 From the International Searching Authority Re. Application No. PCT/IB2021/051511 and Its Translation of Search Report Into English. (10 Pages).

* cited by examiner

LED SYSTEM WITHOUT HEAT SINK

RELATED APPLICATIONS

This application is a National Phase of PCT Patent Application No. PCT/IB2021/051511 having International filing date of Feb. 23, 2021, which claims the benefit of priority of French Patent Application No. 2002246 filed on Mar. 5, 2020. The contents of the above applications are all incorporated by reference as if fully set forth herein in their entirety.

FIELD AND BACKGROUND OF THE INVENTION

The present invention relates to a lighting system based on light-emitting diode lamp technology suitable for horticultural, domestic or industrial lighting markets.

SMD-type (Surface Mounted Device) or COB-type (Chip on Board) light-emitting diodes, used in lighting systems, need to be protected, so that they are not in direct contact with the environment in which they operate. Currently, there are mainly two types of protection:

Protecting the diodes by adding a shell or a transparent, rigid wall. The air is then trapped with the diodes. If the device is not to be limited in power, the circuit will need to be cooled either by adding a radiator at the rear of the diodes (passive system) or by installing a ventilation system to renew the air (active system). Passive systems are bulky and expensive. Active systems are expensive and less durable than the LEDs themselves.

Applying a protective varnish directly to the diodes. Since the thickness of the varnish is small, this will also limit the power of the diodes, due to temperature problems. Moreover, the system will remain sensitive to shocks and handling. Lastly, applying the varnish remains a delicate process and requires expensive production tools.

SUMMARY OF THE INVENTION

The device, according to the invention, makes it possible to remedy these disadvantages by providing a powerful, robust and durable lighting system with a protection rating of up to IP69, while maintaining a low manufacturing cost.

The principle of the invention is to use a translucent or transparent heat-shrinkable sheath whose thermal conductivity is around ten times greater than that of air. An insulated metal substrate in the form of a straight block, twice as long as it is wide and twice as wide as it is thick, is inserted into this sheath. At least one SMD or COB surface-mounted light-emitting diode, as well as a connector or power cable at the end, will have already been placed on one of the two larger surfaces. When "shrunk", the sleeve will be in direct contact with the diodes and the circuit, leaving no confined air. The material of the sheath will then allow the heat of the circuit to be evenly dissipated, while protecting the circuit from any external damage and human contact. The ends are then overmoulded to electrically seal the system, using a polymer.

According to particular embodiments:

The overmoulding may be made of an elastomer and thus used to create a lip around the power connector, which will fit over the complementary connector when inserted. This lip will provide a higher protection rating connection than the exposed connector, thus saving cost.

The substrate may have two recesses at its ends, passing through the thickness and located outside the area covered by the sheath, recesses that the overmoulding will cover without sealing. These recesses allow the device to be attached by means of screws or plastic clips.

A second metal alloy block, with a higher modulus of elasticity than the substrate and having two recesses corresponding to the recesses of the first block, may be stuck to the first block, opposite the surface of the diodes, by means of a thermally conductive material, in order to make the system more rigid.

The overmoulding may be used to create additional recesses, which are not both circular and concentric to the two attachment recesses. These recesses will prevent the lighting system from rotating around the attachment axes, thus allowing multiple lighting systems to be combined together, using the inherent rigidity of each system.

BRIEF DESCRIPTION OF THE SEVERAL VIEWS OF THE DRAWINGS

The appended drawings illustrate the invention.

DESCRIPTION OF SPECIFIC EMBODIMENTS OF THE INVENTION

Figure 1:
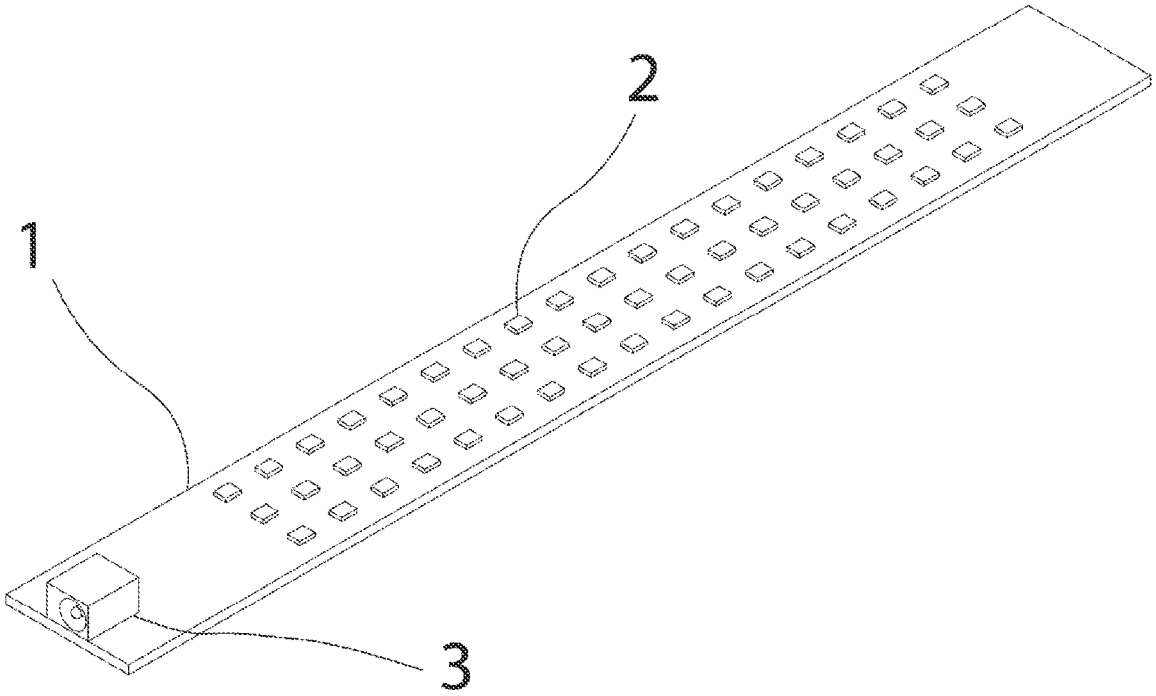
FIG. 1 is a perspective view of the insulated metal substrate with an LED array as well as a connector installed on one of the two larger surfaces.
Figure 2:
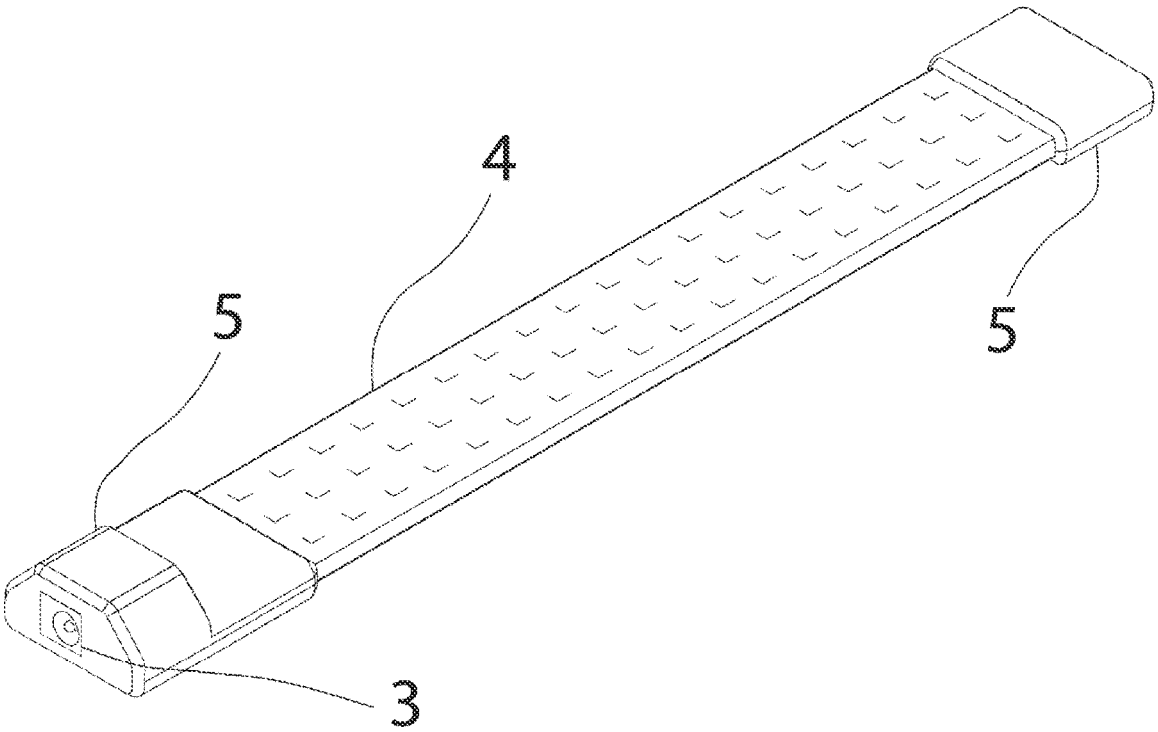
FIG. 2 is a perspective view of the circuit coated with the heat-shrunk sheath and overmoulded at the ends by the polymer.

With reference to the drawings, FIG. 1 shows a device comprising an insulated metal substrate (1), on which a connector (3) and an array of surface-mounted light-emitting diodes (2) are placed. In FIG. 2, the substrate (1) and the array of diodes (2) are inserted into a heat-shrinkable sheath (4), so as to remove the air trapped between the diodes and the sheath. An elastomeric overmoulding (5) covers each of the two ends of the substrate (1) and the sheath (4), as well as the connector (3) at one of the ends, so as to ensure the protection and sealing of the array.

Figure 3:
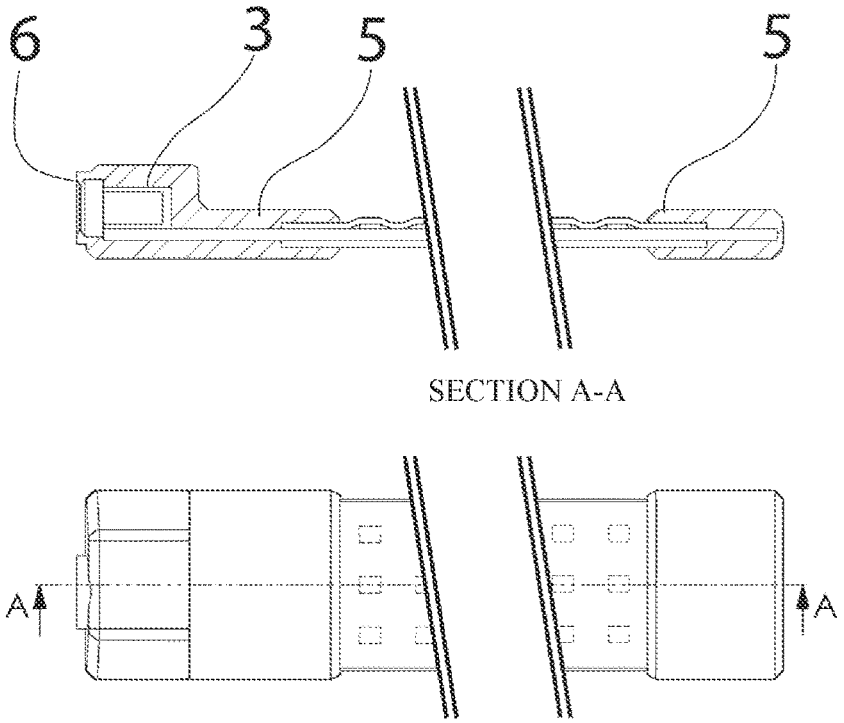
FIG. 3 is a longitudinal section view of the lighting system with the sealing lip around the connector.

In the embodiment according to FIG. 3, the overmoulding (5) around the connector (3) forms a circular lip (6), which will fit and compress around the complementary power connector, in order to increase the protection rating of the exposed connector.

Figure 4:
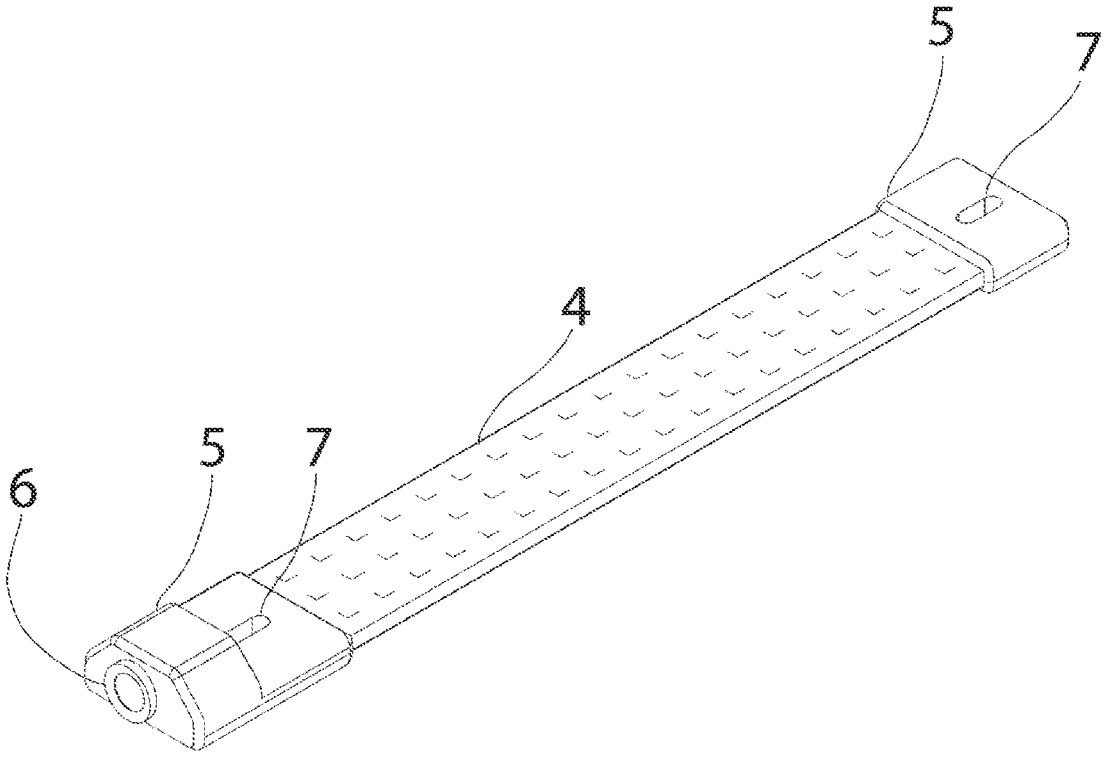
FIG. 4 is a perspective view of the lighting system with an attachment recess at each end.

In the embodiment according to FIG. 4, the overmoulding (5) has a recess (7), which is smaller than the recess of the substrate, in order to cover it without sealing it and thus to allow the device to be attached by means of clips or screws.

Figure 5:
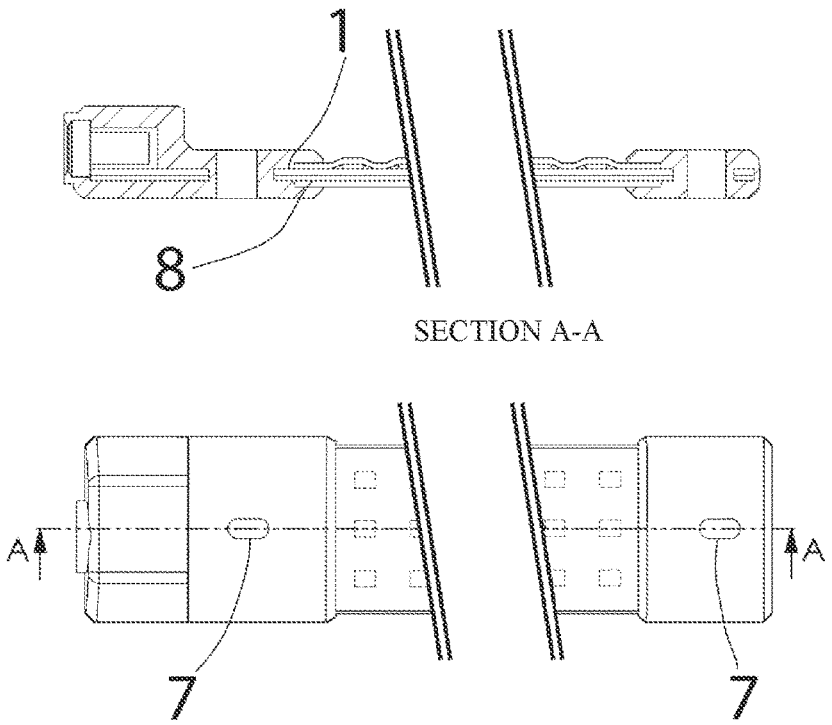
FIG. 5 is a longitudinal section view of the lighting system with a second metal alloy block stuck to the substrate.

In the embodiment according to FIG. 5, a metal block (8) is stuck to the back of the substrate (1) by means of a double-sided thermally conductive adhesive tape, before wrapping the device in the heat-shrinkable sheath and overmoulding it at its ends, in order to increase the mechanical rigidity of the array.

Figure 6:
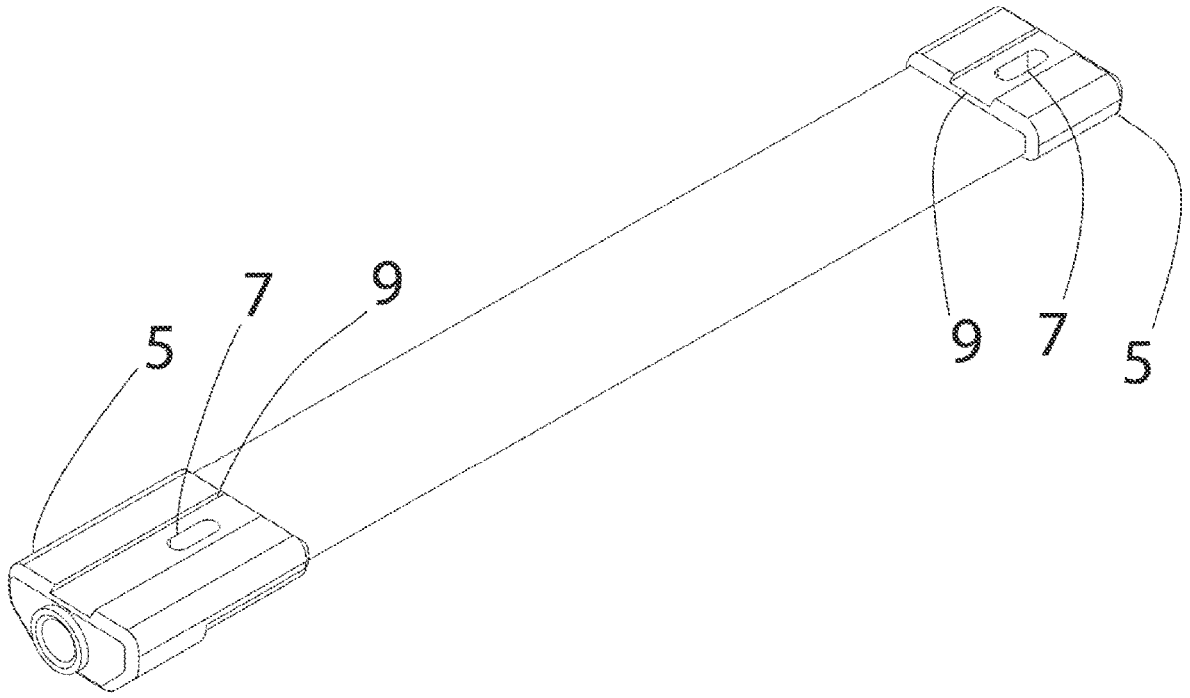
FIG. 6 is a perspective view of the lighting system with a non-circular recess at each end.
Figure 7:
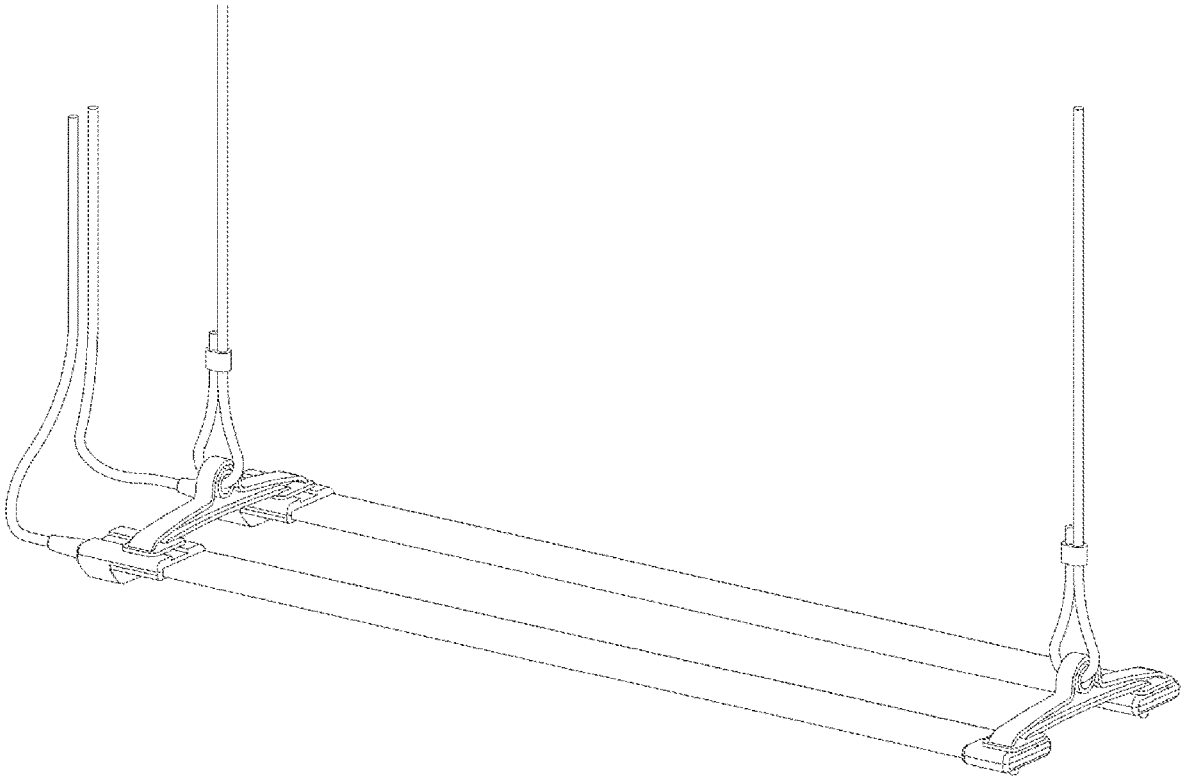
FIG. 7 is a perspective view of two lighting systems attached together by means of two brackets.

In the embodiment according to FIG. 6, recesses (9) are made during overmoulding, around the attachment recesses (7), to prevent rotation between the lighting system and the holding parts to be clipped on. An example of the assembly of two lighting systems is shown in FIG. 7.

By way of non-limiting example, the substrate, made of aluminium, will have dimensions of around 500 millimetres long, 30 millimetres wide and 1 millimetre thick. The metal block to increase rigidity will have the same dimensions and will be made of stainless steel. The diodes will be of the SMD2835 type, and will consume 20 watts in total. The connector will be of DC 5.5×2.1 millimetres type. The overmoulding will consist of a thermoplastic elastomer in order to facilitate moulding. The material used for the heat-shrinkable sheath will be a fluoropolymer with a shrinkage temperature greater than 140° C., in order to remain stable under the temperature of the diodes which can reach 80° C. It can be translucent or transparent depending on the intended application.

The device according to the invention is particularly intended for domestic, industrial and horticultural lighting.

What is claimed is:

1. A device comprising:

an insulated metal substrate (1) in a form of a straight block, a length at least twice as great as a width of the insulated metal substrate (1), which is at least twice as great as a thickness of the insulated metal substrate (1);

wherein the insulated metal substrate (1) having two larger surfaces, one of which has at least one SMD-type (Surface Mounted Device) or COB-type (Chip_on_Board) light-emitting diode (2), supplied by a connector (3);

wherein said substrate (1) is covered with a transparent or translucent heat-shrinkable sheath (4) covering diodes;

wherein ends of the substrate (1) and the sheath (4) are overmoulded by a polymer (5) electrically insulating the device.

2. The device according to claim 1, the overmoulding (5) is an elastomer, and at the opening of the connector, the overmoulding (5) has a lip (6) that seals the connection (3).

3. The device according to claim 2, wherein the substrate (1) has a recess (7) at each end, passing through the thickness, and located outside an area covered by the sheath (4), recesses that the overmoulding (5) covers without sealing.

4. The device according to claim 3, wherein a second block (8) consisting of a metal alloy with a higher modulus of elasticity than the insulated metal substrate (1) having two recesses which correspond to the recesses (7) of the insulated metal substrate (1) is stuck to the substrate (1) on the surface opposite the diodes, by means of a thermally conductive material.

5. The device according to claim 4, wherein each end of the device has a recess (9) in the overmoulding that is not both circular and concentric to the recess (7).

6. The device according to claim 3, wherein each end of device has a recess (9) in the overmoulding which is not both circular and concentric to the recess (7).

7. A device comprising:

an insulated metal substrate (1) in a form of a straight block, a length of which is at least twice as great as a width of the insulated metal substrate (1), which is at least twice as great as a thickness of the insulated metal substrate (1);

wherein the device comprises two larger surfaces, one of which having at least one SMD-type (Surface Mounted Device) or COB-type (Chip on Board) light-emitting diode (2), supplied by a cable;

wherein said substrate (1) is covered with a transparent or translucent heat-shrinkable sheath (4) covering diodes;

wherein ends of the substrate (1) and the sheath (4) are overmoulded by a polymer (5) electrically insulating the device.

* * * * *